US005762734A

United States Patent [19]

DeLucia et al.

[11] Patent Number: 5,762,734

[45] Date of Patent: Jun. 9, 1998

[54] PROCESS OF MAKING FIBERS

[75] Inventors: Mary Lucille DeLucia, Roswell; Samuel Edward Marmon, Alpharetta, both of Ga.

[73] Assignee: Kimberly-Clark Worldwide, Inc., Neenah, Wis.

[21] Appl. No.: 708,009

[22] Filed: Aug. 30, 1996

[51] Int. Cl.[6] ..... D01D 5/08; D04H 3/10; D04H 3/16

[52] U.S. Cl. ..... 156/73.2; 156/148; 156/181; 264/103; 264/143; 264/176.1; 264/211

[58] Field of Search ..... 264/103, 143, 264/176.1, 211; 156/73.2, 148, 181

[56] References Cited

U.S. PATENT DOCUMENTS

| | | | |
|---|---|---|---|
| 3,262,153 | 7/1966 | Mercer et al. | 425/463 |
| 3,338,992 | 8/1967 | Kinney | 264/441 |
| 3,341,394 | 9/1967 | Kinney | 442/366 |
| 3,408,277 | 10/1968 | Martin et al. | 264/168 |
| 3,502,763 | 3/1970 | Hartmann | 264/555 |
| 3,542,615 | 11/1970 | Dobo et al. | 156/181 |
| 3,584,339 | 6/1971 | Yutaka et al. | 425/131.5 |
| 3,639,573 | 2/1972 | Port | 264/75 |
| 3,669,788 | 6/1972 | Allman, Jr. et al. | 156/167 |
| 3,692,618 | 9/1972 | Dorschner et al. | 442/401 |
| 3,780,149 | 12/1973 | Keuchel et al. | 264/168 |
| 3,802,817 | 4/1974 | Matsuki et al. | 425/66 |
| 3,849,241 | 11/1974 | Butin et al. | 428/137 |
| 4,041,203 | 8/1977 | Brock et al. | 428/157 |
| 4,124,673 | 11/1978 | Pieper et al. | 264/172.11 |
| 4,269,888 | 5/1981 | Ejima et al. | 428/370 |
| 4,323,534 | 4/1982 | DesMarais | 264/211.14 |
| 4,340,563 | 7/1982 | Appel et al. | 264/518 |
| 4,445,833 | 5/1984 | Moriki et al. | 425/131.5 |
| 4,542,199 | 9/1985 | Kaminsky et al. | 526/160 |
| 4,551,378 | 11/1985 | Carey, Jr. | 428/198 |
| 4,663,220 | 5/1987 | Wisneski et al. | 428/221 |
| 4,707,398 | 11/1987 | Boggs | 428/224 |
| 4,724,184 | 2/1988 | Killian et al. | 428/227 |
| 4,741,949 | 5/1988 | Morman et al. | 428/224 |
| 4,756,969 | 7/1988 | Takeda | 428/372 |
| 4,787,699 | 11/1988 | Moulin | 385/80 |
| 4,795,668 | 1/1989 | Krueger et al. | 428/174 |
| 4,803,117 | 2/1989 | Daponte | 428/228 |
| 4,820,572 | 4/1989 | Killian et al. | 428/227 |
| 4,834,738 | 5/1989 | Kielpikowski et al. | 604/385.2 |
| 4,923,742 | 5/1990 | Killian et al. | 428/283 |
| 5,057,368 | 10/1991 | Largman et al. | 428/397 |
| 5,069,970 | 12/1991 | Largman et al. | 428/373 |
| 5,082,720 | 1/1992 | Hayes | 428/224 |
| 5,093,422 | 3/1992 | Himes | 525/98 |
| 5,108,820 | 4/1992 | Kaneko et al. | 428/198 |
| 5,108,827 | 4/1992 | Gessner | 428/219 |
| 5,145,727 | 9/1992 | Potts et al. | 428/198 |
| 5,169,706 | 12/1992 | Collier, IV et al. | 428/152 |
| 5,178,931 | 1/1993 | Perkins et al. | 428/198 |
| 5,188,885 | 2/1993 | Timmons et al. | 428/198 |
| 5,189,192 | 2/1993 | LaPointe et al. | 556/11 |
| 5,200,443 | 4/1993 | Hudson | 524/99 |
| 5,277,976 | 1/1994 | Hogle et al. | 428/397 |
| 5,294,482 | 3/1994 | Gessner | 428/287 |
| 5,304,599 | 4/1994 | Himes | 525/98 |
| 5,318,552 | 6/1994 | Shiba et al. | 604/366 |
| 5,332,613 | 7/1994 | Taylor et al. | 428/152 |
| 5,336,552 | 8/1994 | Strack et al. | 428/224 |
| 5,349,100 | 9/1994 | Mintz | 585/350 |
| 5,352,749 | 10/1994 | DeChellis et al. | 526/68 |
| 5,382,400 | 1/1995 | Pike et al. | 264/168 |
| 5,451,357 | 9/1995 | Cloeren | 264/173.16 |
| 5,451,462 | 9/1995 | Taniguchi et al. | 428/373 |
| 5,466,410 | 11/1995 | Hills | 264/172.11 |
| 5,468,555 | 11/1995 | Lijten et al. | 428/365 |
| 5,534,335 | 7/1996 | Everhart et al. | 428/224 |

FOREIGN PATENT DOCUMENTS

| | | | |
|---|---|---|---|
| 0 445 536 A2 | 9/1991 | European Pat. Off. . | |
| 0 552 013 A2 | 7/1993 | European Pat. Off. . | |
| 25 13 251 A1 | 9/1976 | Germany | 264/172.14 |
| 25 50 081 B1 | 4/1977 | Germany | 264/172.14 |
| 54-34420 | 3/1979 | Japan | 264/172.15 |
| 62-177208 | 8/1987 | Japan | 264/172.11 |
| 1087823 | 10/1967 | United Kingdom . | |
| 1116823 | 6/1968 | United Kingdom . | |
| 1179615 | 1/1970 | United Kingdom | 264/172.14 |

OTHER PUBLICATIONS

Article by Don E. Floyd, "Polyamide Resins", Reinhold Publishing Corp., Copyright 1966, pp. 31 through 53.

Article by K. B. Wagener, "Oscillating Catalysts: A New Twist for Plastics", *Science*, vol. 267, Jan. 13, 1995, p. 191.

Article by Geoffrey W. Coates and Robert M. Waymouth, "Oscillating Stereocontrol: A Strategy for the Synthesis of Thermoplastic Elastomeric Polypropylene", *Science*, vol. 267, Jan. 13, 1995, pp. 217 through 219.

Article by John A. Manson and Leslie H. Sperling, "Polymer Blends and Composites", ISBN 0-306-30831-2, 1976 Plenum Press, New York, pp. 273 through 277.

*Primary Examiner*—Leo B. Tentoni

*Attorney, Agent, or Firm*—William D. Herrick; James B. Robinson

[57] ABSTRACT

A method of producing a fiber is provided where a liquefied polymer is divided into at least two streams. The streams are directed separately to a point of recombination, and extruded through, for example, a spinneret, and fiberized to form a single fiber having portions of each stream. The divided polymer streams are treated substantially identically from the point of division to the point of recombination.

21 Claims, No Drawings

PROCESS OF MAKING FIBERS

BACKGROUND OF THE INVENTION

This invention relates generally to a nonwoven fiber and fabric or webs which are formed from such fibers, and laminates using such a web as a component. The fibers are made from a thermoplastic resin.

Thermoplastic resins have been extruded to form fibers, fabrics and webs for a number of years. The most common thermoplastics for this application are polyolefins, particularly polypropylene. Other materials such as polyesters, polyetheresters, polyamides and polyurethanes are also used to form nonwoven spunbond fabrics.

Nonwoven fabrics or webs are useful for a wide variety of applications such as diapers, feminine hygiene products, towels, recreational or protective fabrics and as geotextiles and filter media. The nonwoven webs used in these applications may be simply spunbond fabrics but are often in the form of nonwoven fabric laminates like spunbond/spunbond (SS) laminates or spunbond/meltblown/spunbond (SMS) laminates.

Spunbond fibers are commonly monocomponent fibers but may be multicomponent as well. Multicomponent fibers may be conjugate or biconstituent fibers, or a combination of the two. The term "conjugate fibers" has traditionally referred to fibers formed from more than one polymer from more than one extruder where the polymer portions remain substantially unmixed and continuous along the length of the fiber. The term "biconstituent fibers" has traditionally referred to fibers formed from a mixture or blend of polymers where each polymer is not continuous along the length of the fiber.

Conjugate and biconstituent fibers are known in the art. Good examples of conjugate fibers may be found in U.S. Pat. No. 5,382,400 to Pike et al., commonly assigned. A good example of biconstituent fibers may be found in U.S. Pat. No. 5,534,335 to Everhart et al.

Much of the prior efforts to produce conjugate or biconstituent fibers have focused on combining polymers which normally are not especially compatible, such as polyolefins and polyamides, or different polyolefins like polypropylene and polyethylene. Little attention has been directed toward producing a conjugate fiber, for example, from the same polymer, and those who have investigated this area have used the traditional conjugate production mechanism of using an extruder for each part of the fiber. U.S. Pat. 5,318,552 to Shiba, for example, provides a conjugate fiber where both portions are made from the same type of polymer, polyester, however the polyesters chosen must have a melting temperature at least 50° C. apart. U.S. Pat. 4,551,378 to Carey, Jr., like Shiba, teaches conjugate fibers having portions which may be from the same class of polymers but which have a difference in melting point. U.S. Pat. 5,451,462 to Taniguchi et al. teaches a conjugate fiber made only from polypropylene but uses polypropylenes having different isotactic pentad ratios. U.S. patent application Ser. No. 08/375,196, commonly assigned, teaches the production of conjugate fibers from separate extruders but using the same polymer, unmodified in any way. U.S. Pat. 3,780,149 to Keuchel et al. Teaches production of a fiber having multiple portions from only one extruder and using the same starting polymer. Keuchel et al., however, divide the polymer and subject the divided streams to different shear and thermal environments prior to fiberization in order to improve the fiber's crimp potential.

It has apparently seemed pointless to produce a multiportioned fiber using the same polymer from the same extruder, perhaps because of the cost involved or skepticism about the quality of the fiber, and it is the object of this invention to produce such a fiber. It is a further object of this invention to produce a nonwoven fabric made from such a fiber.

SUMMARY OF THE INVENTION

The objects of this invention are achieved by a method of producing a fiber where a polymer is liquefied, divided into at least two portions, recombined, and extruded to form a single fiber. The streams are directed separately to the point of recombination and are then extruded through, for example, a spinneret, and fiberized to form a single fiber having portions of each stream. The divided polymer streams are treated substantially identically from the point of division to the point of recombination. The fiber so produced may be continuous or discontinuous and may be processed into staple fiber by cutting. The fiber may be a microfiber or much larger. Any polymer which may be successfully liquefied and extruded may be used in the practice of this invention.

DEFINITIONS

As used herein the term "nonwoven fabric or web" means a web having a structure of individual fibers or threads which are interlaid, but not in an identifiable manner as in a knitted fabric. Nonwoven fabrics or webs have been formed from many processes such as for example, meltblowing processes, spunbonding processes, and bonded carded web processes. The basis weight of nonwoven fabrics is usually expressed in ounces of material per square yard (osy) or grams per square meter (gsm) and the fiber diameters useful are usually expressed in microns. (Note that to convert from osy to gsm, multiply osy by 33.91).

As used herein the term "microfibers" means small diameter fibers having an average diameter not greater than about 75 microns, for example, having an average diameter of from about 0.5 microns to about 50 microns, or more particularly, microfibers may have an average diameter of from about 2 microns to about 40 microns. Another frequently used expression of fiber diameter is denier, which is defined as grams per 9000 meters of a fiber and may be calculated as fiber diameter in microns squared, multiplied by the density in grams/cc, multiplied by 0.00707. A lower denier indicates a finer fiber and a higher denier indicates a thicker or heavier fiber. For example, the diameter of a polypropylene fiber given as 15 microns may be converted to denier by squaring, multiplying the result by .89 g/cc and multiplying by .00707. Thus, a 15 micron polypropylene fiber has a denier of about 1.42 ($15^2 \times 0.89 \times .00707 = 1.415$). Outside the United States the unit of measurement is more commonly the "tex", which is defined as the grams per kilometer of fiber. Tex may be calculated as denier/9.

As used herein the term "spunbond fibers" refers to small diameter fibers which are formed by extruding molten thermoplastic material as filaments from a plurality of fine, usually circular capillaries of a spinneret with the diameter of the extruded filaments then being rapidly reduced as by, for example, in U.S. Pat. No. 4,340,563 to Appel et al., U.S. Pat. No. 3,692,618 to Dorschner et al., U.S. Pat. No. 3,802,817 to Matsuki et al., U.S. Pat. No. 3,338,992 and 3,341,394 to Kinney, U.S. Pat. No. 3,502,763 to Hartman, and U.S. Pat. No. 3,542,615 to Dobo et al. Spunbond fibers are generally not tacky when they are deposited onto a collecting surface. Spunbond fibers are generally continuous and have average diameters (from a sample of at least 10)

larger than 7 microns, more particularly, between about 10 and 20 microns.

As used herein the term "meltblown fibers" means fibers formed by extruding a molten thermoplastic material through a plurality of fine, usually circular, die capillaries as molten threads or filaments into converging high velocity, usually hot, gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed, for example, in U.S. Pat. No. 3,849,241 to Butin et al. Meltblown fibers are microfibers which may be continuous or discontinuous, are generally smaller than 10 microns in average diameter, and are generally tacky when deposited onto a collecting surface.

As used herein "multilayer laminate" means a laminate wherein some of the layers are spunbond and some meltblown such as a spunbond/meltblown/spunbond (SMS) laminate and others as disclosed in U.S. Pat. No. 4,041,203 to Brock et al., U.S. Pat. No. 5,169,706 to Collier, et al, U.S. Pat. No. 5,145,727 to Potts et al., U.S. Pat. No. 5,178,931 to Perkins et al. and U.S. Pat. No. 5,188,885 to Timmons et al. Such a laminate may be made by sequentially depositing onto a moving forming belt first a spunbond fabric layer, then a meltblown fabric layer and last another spunbond layer and then bonding the laminate in a manner described below. Alternatively, the fabric layers may be made individually, collected in rolls, and combined in a separate bonding step. Such fabrics usually have a basis weight of from about 0.1 to 12 osy (6 to 400 gsm), or more particularly from about 0.75 to about 3 osy. Multilayer laminates may also have various numbers of meltblown layers or multiple spunbond layers in many different configurations and may include other materials like films (F) or coform materials, e.g. SMMS, SM, SFS, etc.

As used herein the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries.

As used herein the term "monocomponent" fiber refers to a fiber formed from one or more extruders using only one polymer. This is not meant to exclude fibers formed from one polymer to which small amounts of additives have been added for color, anti-static properties, lubrication, hydrophilicity, etc. These additives, e.g. titanium dioxide for color, are generally present in an amount less than 5 weight percent and more typically about 2 weight percent.

As used herein the term "conjugate fibers" refers to fibers which have been formed from at least two polymers extruded from separate extruders but spun together to form one fiber. Conjugate fibers are also sometimes referred to as multicomponent or bicomponent fibers. The polymers are usually different from each other though conjugate fibers may be monocomponent fibers. The polymers are arranged in substantially constantly positioned distinct zones across the cross-section of the conjugate fibers and extend continuously along the length of the conjugate fibers. The configuration of such a conjugate fiber may be, for example, a sheath/core arrangement wherein one polymer is surrounded by another or may be a side by side arrangement, a pie arrangement or an "islands-in-the-sea" arrangement. Conjugate fibers are taught in U.S. Pat. No. 5,108,820 to Kaneko et al., U.S. Pat. No. 4,795,668 to Krueger et al. and U.S. Pat. No. 5,336,552 to Strack et al. Conjugate fibers are also taught in U.S. Pat. No. 5,382,400 to Pike et al. and may be used to produce crimp in the fibers by using the differential rates of expansion and contraction of the two (or more) polymers. Crimped fibers may also be produced by mechanical means and by the process of German Patent DT 25 13 251 A1. For two component fibers, the polymers may be present in ratios of 75/25, 50/50, 25/75 or any other desired ratios. The fibers may also have shapes such as those described in U.S. Pat. No. 5,277,976 to Hogle et al., U.S. Pat. No. 5,466,410 to Hills and 5,069,970 and 5,057,368 to Largman et al., which describe fibers with unconventional shapes.

As used herein the term "biconstituent fibers" refers to fibers which have been formed from at least two polymers extruded from the same extruder as a blend. The term "blend" is defined below. Biconstituent fibers do not have the various polymer components arranged in relatively constantly positioned distinct zones across the cross-sectional area of the fiber and the various polymers are usually not continuous along the entire length of the fiber, instead usually forming fibrils or protofibrils which start and end at random. Biconstituent fibers are sometimes also referred to as multiconstituent fibers. Fibers of this general type are discussed in, for example, U.S. Pat. No. 5,108,827 and 5,294,482 to Gessner. Bicomponent and biconstituent fibers are also discussed in the textbook *Polymer Blends and Composites* by John A. Manson and Leslie H. Sperling, copyright 1976 by Plenum Press, a division of Plenum Publishing Corporation of New York, IBSN 0-306-30831-2, at pages 273 through 277.

As used herein the term "blend" means a mixture of two or more polymers while the term "alloy" means a sub-class of blends wherein the components are immiscible but have been compatibilized.

As used herein the term "single extruder multiportion fibers" means fibers made from only one extruder and one polymer but having portions like a conjugate fiber. The configuration of such a fiber may be, for example, a sheath/core arrangement wherein one portion is surrounded by another or may be a side by side arrangement, a pie arrangement or an "islands-in-the-sea" arrangement.

TEST METHODS

Melt Flow Rate: The melt flow rate (MFR) is a measure of the viscosity of a polymer. The MFR is expressed as the weight of material which flows from a capillary of known dimensions under a specified load or shear rate for a measured period of time and is measured in grams/10 minutes at a set temperature and load according to, for example, ASTM test 1238-90b.

DETAILED DESCRIPTION

The process of this invention may be used to produce fibers, including staple fibers and continuous fibers which may be further processed into nonwoven, woven or knitted fabrics. Common processes for the production of man-made fibers include the meltblowing process, the spunbond process, solution spinning, various carpet yarn manufacturing processes and others known to those skilled in the art.

One well known process is the spunbond process. The spunbond process generally uses a hopper which supplies polymer to a heated extruder which melts the polymer. The extruder supplies liquefied polymer to a spinneret where the polymer is fiberized as it passes through fine orifices or openings arranged in one or more rows in the spinneret, forming a curtain of filaments. The filaments are usually quenched with air at a low pressure, drawn, usually pneumatically, and deposited or collected on a moving foraminous mat, belt or "forming wire" to form the nonwoven web. Polymers useful in the spunbond process generally have a process melt temperature of between about 400° F. to about 610° F. (200° C. to 320° C.).

The fibers produced in the spunbond process are usually in the range of from about 10 to about 50 microns in average diameter, depending on process conditions and the desired end use for the webs to be produced from such fibers. For example, increasing the polymer molecular weight or decreasing the processing temperature results in larger diameter fibers. Changes in the quench fluid temperature and pneumatic draw pressure can also affect fiber diameter. The fibers produced by the spunbond process usually have average diameters in the range of from about 7 to about 35 microns, more particularly from about 10 to about 25 microns while those produced by other methods may be much larger. Carpet yams; for example, are much larger than 50 microns in diameter in the range of 100 to 200 denier and greater.

The fiber of this invention may be formed into a multilayer laminate which may be formed by a number of different techniques including but not limited to using adhesive, needlepunching, stitchbonding, ultrasonic bonding, thermal calendering and any other method known in the art. Such a multilayer laminate may be an embodiment wherein some of the layers are produced by the spunbond method and some produced by the meltblown method such as a spunbond/meltblown/spunbond (SMS) laminate as disclosed in U.S. Pat. No. 4,041,203 to Brock et al. and U.S. Pat. No. 5,169,706 to Collier, et al. or as a spunbond/spunbond laminate. An SMS laminate may be made by sequentially depositing onto a moving conveyor belt or forming wire first a spunbond web layer, then a meltblown web layer and last another spunbond layer and then bonding the laminate in a manner described above. Alternatively, the three web layers may be made individually, collected in rolls, and combined in a separate bonding step.

The polymers used to produce the fibers of this invention may be any which may be liquefied and extruded such as polyamides, polyurethane, polyvinylchloride, polytetrafluoroethylene, polystyrene, polyethylene terephathalate, polycarbonates, 4-methyl-1-pentene, rayon, acetates, polyesters, and polyolefins, particularly polypropylene and polyethylene. Elastomeric thermoplastic polymers may be processed in the manner of the invention as well. The polymer may be made liquid by melting or by chemical reaction, or other means known in the art.

Many polyolefins are available for fiber production, for example polyethylenes such as Dow Chemical's ASPUN® 6811A linear low density polyethylene, 2553 LLDPE and 25355 and 12350 high density polyethylene are such suitable polymers. The polyethylenes have melt flow rates, respectively, of about 26, 40, 25 and 12. Fiber forming polypropylenes include Exxon Chemical Company's Escorene® PD 3445 polypropylene, numerous polypropylenes from the Shell Chemical Company and Montell Chemical Co.'s PF-304. Many other polyolefins are commercially available.

Elastomeric thermoplastic polymers useful in the practice of this invention may be those made from block copolymers such as polyurethanes, copolyether esters, polyamide polyether block copolymers, ethylene vinyl acetates (EVA), block copolymers having the general formula A-B-A' or A-B like copoly(styrene/ethylene-butylene), styrene-poly (ethylene-propylene)-styrene, styrene-poly(ethylene-butylene)-styrene, (polystyrene/poly(ethylene-butylene)/polystyrene, poly (styrene/ethylene-butylene/styrene) and the like.

Useful elastomeric resins include block copolymers having the general formula A-B-A' or A-B, where A and A' are each a thermoplastic polymer endblock which contains a styrenic moiety such as a poly (vinyl arene) and where B is an elastomeric polymer midblock such as a conjugated diene or a lower alkene polymer. Block copolymers of the A-B-A' type can have different or the same thermoplastic block polymers for the A and A' blocks, and the present block copolymers are intended to embrace linear, branched and radial block copolymers. In this regard, the radial block copolymers may be designated $(A—B)_m—X$, wherein X is a polyfunctional atom or molecule and in which each $(A—B)_m$—radiates from X in a way that A is an endblock. In the radial block copolymer, X may be an organic or inorganic polyfunctional atom or molecule and m is an integer having the same value as the functional group originally present in X. It is usually at least 3, and is frequently 4 or 5, but not limited thereto. Thus, in the present invention, the expression "block copolymer", and particularly "A-B-A'" and "A-B" block copolymer, is intended to embrace all block copolymers having such rubbery blocks and thermoplastic blocks as discussed above, which can be extruded (e.g., by meltblowing), and without limitation as to the number of blocks. The elastomeric nonwoven web may be formed from, for example, elastomeric (polystyrene/poly (ethylene-butylene)/polystyrene) block copolymers. Commercial examples of such elastomeric copolymers are, for example, those known as KRATON® materials which are available from Shell Chemical Company of Houston, Tex. KRATON® block copolymers are available in several different formulations, a number of which are identified in U.S. Pat. No. 4,663,220, 4,323,534, 4,834,738, 5,093,422 and 5,304,599, hereby incorporated by reference.

Polymers composed of an elastomeric A—B—A—B tetrablock copolymer may also be used in the practice of this invention. Such polymers are discussed in U.S. Pat. No. 5,332,613 to Taylor et al. In such polymers, A is a thermoplastic polymer block and B is an isoprene monomer unit hydrogenated to a substantially a poly(ethylene-propylene) monomer unit. An example of such a tetrablock copolymer is a styrene-poly(ethylene-propylene)-styrene-poly (ethylene-propylene) or SEPSEP elastomeric block copolymer available from the Shell Chemical Company of Houston, Tex. under the trade designation KRATON® G-1657.

Other exemplary elastomeric materials which may be used include polyurethane elastomeric materials such as, for example, those available under the trademark ESTANE® from B. F. Goodrich & Co. or MORTHANE® from Morton Thiokol Corp., polyester elastomeric materials such as, for example, those available under the trade designation HYTREL® from E. I. duPont De Nemours & Company, and those known as ARNITEL®, formerly available from Akzo Plastics of Amhem, Holland and now available from DSM of Sittard, Holland.

Another suitable material is a polyester block amide copolymer having the formula:

$$HO\left[C(=O)-PA-C(=O)-O-PE-O\right]_n H$$

where n is a positive integer, PA represents a polyamide polymer segment and PE represents a polyether polymer segment. In particular, the polyether block amide copolymer has a melting point of from about 150° C. to about 170° C., as measured in accordance with ASTM D-789; a melt index of from about 6 grams per 10 minutes to about 25 grams per 10 minutes, as measured in accordance with ASTM D-1238, condition Q (235 C/1Kg load); a modulus of elasticity in flexure of from about 20 Mpa to about 200 Mpa, as measured in accordance with ASTM D-790; a tensile strength at break of from about 29 Mpa to about 33 Mpa as measured in accordance with ASTM D-638 and an ultimate elongation at break of from about 500 percent to about 700 percent as measured by ASTM D-638. A particular embodiment of the polyether block amide copolymer has a melting point of about 152° C. as measured in accordance with ASTM D-789; a melt index of about 7 grams per 10 minutes, as measured in accordance with ASTM D-1238, condition Q (235 C/1Kg load); a modulus of elasticity in flexure of about 29.50 Mpa, as measured in accordance with ASTM D-790; a tensile strength at break of about 29 Mpa, a measured in accordance with ASTM D-639; and an elongation at break of about 650 percent as measured in accordance with ASTM D-638. Such materials are available in various grades under the trade designation PEBAX® from Atochem Inc. Polymers Division (RILSAN®), of Glen Rock, N.J. Examples of the use of such polymers may be found in U.S. Pat. No. 4,724,184, 4,820,572 and 4,923,742 hereby incorporated by reference, to Killian et al. and assigned to the same assignee as this invention.

Elastomeric polymers also include copolymers of ethylene and at least one vinyl monomer such as, for example, vinyl acetates, unsaturated aliphatic monocarboxylic acids, and esters of such monocarboxylic acids. The elastomeric copolymers and formation of elastomeric nonwoven webs from those elastomeric copolymers are disclosed in, for example, U.S. Pat. No. 4,803,117.

The thermoplastic copolyester elastomers include copolyetheresters having the general formula:

$$H-\left(\left[O-G-O-C(=O)-C_6H_4-C(=O)\right]_b-\left[O-(CH_2)_a-O-C(=O)-C_6H_4-C(=O)\right]_m\right)_n-O-(CH_2)_a-OH$$

where "G" is selected from the group consisting of poly (oxyethylene)-alpha,omega-diol, poly (oxypropylene)-alpha,omega-diol, poly(oxytetramethylene)-alpha,omega-diol and "a" and "b" are positive integers including 2, 4 and 6, "m" and "n" are positive integers including 1–20. Such materials generally have an elongation at break of from about 600 percent to 750 percent when measured in accordance with ASTM D-638 and a melt point of from about 350° F. to about 400° F. (176 to 205° C.) when measured in accordance with ASTM D-2117. Commercial examples of such copolyester materials are, for example, those known as ARNITEL®, formerly available from Akzo Plastics of Arnhem, Holland and now available from DSM of Sittard, Holland, or those known as HYTREL® which are available from E. I. duPont de Nemours of Wilmington, Delaware. Formation of an elastomeric nonwoven web from polyester elastomeric materials is disclosed in, for example, U.S. Pat. No. 4,741,949 to Morman et al. and U.S. Pat. No. 4,707,398 to Boggs, hereby incorporated by reference.

The polyamides which may be used in the practice of this invention may be any polyamide known to those skilled in the art including copolymers and mixtures thereof. Examples of polyamides and their methods of synthesis may be found in "Polyamide Resins" by Don E. Floyd (Library of Congress Catalog number 66-20811, Reinhold Publishing, N.Y., 1966). Particularly commercially useful polyamides are nylon-6, nylon 6,6, nylon-11 and nylon-12. These polyamides are available from a number of sources such as Nyltech North America of Manchester, N.H., Emser Industries of Sumter, S.C. (Grilon® & Grilamid® nylons) and Atochem Inc. Polymers Division, of Glen Rock, N.J. (Rilsan® nylons), among others.

Thermoplastic polymers also include a new class of polymers which is referred to as "metallocene" polymers or as produced according to the metallocene process. The metallocene process generally uses a metallocene catalyst which is activated, i.e. ionized, by a co-catalyst.

The metallocene process, and particularly the catalysts and catalyst support systems are the subject of a number of patents. U.S. Pat. No. 4,542,199 to Kaminsky et al. describes a procedure wherein MAO is added to toluene, the metallocene catalyst of the general formula (cyclopentadienyl) 2MeRHal wherein Me is a transition metal, Hal is a halogen and R is cyclopentadienyl or a C1 to C6 alkyl radical or a halogen, is added, and ethylene is then added to form polyethylene. U.S. Pat. No. 5,189,192 to LaPointe et al. and assigned to Dow Chemical describes a process for preparing addition polymerization catalysts via metal center oxidation. U.S. Pat. No. 5,352,749 to Exxon Chemical Patents, Inc. describes a method for polymerizing monomers in fluidized beds. U.S. Pat. No. 5,349,100 describes chiral metallocene compounds and preparation thereof by creation of a chiral center by enantioselective hydride transfer.

Co-catalysts are materials such as methylaluminoxane (MAO) which is the most common, other alkylaluminums and boron containing compounds like tris (pentafluorophenyl)boron, lithium tetrakis (pentafluorophenyl)boron, and dimethylanilinium tetrakis (pentafluorophenyl)boron. Research is continuing on other co-catalyst systems or the possibility of minimizing or even eliminating the alkylaluminums because of handling and product contamination issues. The important point is that the metallocene catalyst be activated or ionized to a cationic form for reaction with the monomer(s) to be polymerized.

Polymers produced using metallocene catalysts have the unique advantage of having a very narrow molecular weight range. Polydispersity numbers (Mw/Mn) of below 4 and as even below 2 are possible for metallocene produced polymers. These polymers also have a narrow short chain branching distribution when compared to otherwise similar Ziegler-Natta produced type polymers.

It is also possible using a metallocene catalyst system to control the isotacticity of the polymer quite closely when stereo selective metallocene catalysts are employed. In fact, polymers have been produced having an isotacticity of in excess of 99 percent. It is also possible to produce highly syndiotactic polypropylene using this system.

Controlling the isotacticity of a polymer can also result in the production of a polymer which contains blocks of isotactic and blocks of atactic material alternating over the length of the polymer chain. This construction results in an elastic polymer by virtue of the atactic portion. Such polymer synthesis is discussed in the journal *Science*, vol. 267, (13 January 1995) at p. 191 in an article by K. B. Wagener. Wagner, in discussing the work of Coates and Waymouth, explains that the catalyst oscillates between the stereochemical forms resulting in a polymer chain having running lengths of isotactic sterocenters connected to running lengths of atactic centers. Isotactic dominance is reduced producing elasticity. Geoffrey W. Coates and Robert M. Waymouth, in an article entitled "Oscillating Stereocontrol: A Strategy for the Synthesis of Thermoplastic Elastomeric Polypropylene" at page 217 in the same issue, discuss their work in which they used metallocene bis(2-phenylindenyl) -zirconium dichloride in the presence of methylaluminoxane (MAO), and, by varying the pressure and temperature in the reactor, oscillate the polymer form between isotactic and atactic.

Commercial production of metallocene polymers is somewhat limited but growing. Such polymers are available from Exxon Chemical Company of Baytown, Texas under the trade name EXXPOL® for polypropylene based polymers and EXACT® for polyethylene based polymers. Dow Chemical Company of Midland, Mich. has polymers commercially available under the name ENGAGE®. These materials are believed to be produced using non-stereo selective metallocene catalysts. Exxon generally refers to their metallocene catalyst technology as "single site" catalysts while Dow refers to theirs as "constrained geometry" catalysts under the name INSIGHT® to distinguish them from traditional Ziegler-Natta catalysts which have multiple reaction sites. Other manufacturers such as Fina Oil, BASF, Amoco, Hoechst and Mobil are active in this area and it is believed that the availability of polymers produced according to this technology will grow substantially in the next decade. In the practice of the instant invention, elastic polyolefins like polypropylene and polyethylene are preferred, most especially elastic polypropylene.

In addition, a compatible tackifying resin may be added to the extrudable compositions described above to provide tackified materials that autogenously bond. Any tackifier resin can be used which is compatible with the polymers and can withstand the high processing (e.g., extrusion) temperatures. If the polymer is blended with processing aids such as, for example, polyolefins or extending oils, the tackifier resin should also be compatible with those processing aids. Generally, hydrogenated hydrocarbon resins are preferred tackifying resins, because of their better temperature stability. REGALREZ® and ARKON® P series tackifiers are examples of hydrogenated hydrocarbon resins. ZONATAC®501 lite is an example of a terpene hydrocarbon. REGALREZ® hydrocarbon resins are available from Hercules Incorporated. ARKON® P series resins are available from Arakawa Chemical (USA) Incorporated. The tackifying resins such as disclosed in U.S. Pat. No. 4,787,699, hereby incorporated by reference, are suitable. Other tackifying resins which are compatible with the other components of the composition and can withstand the high processing temperatures, can also be used.

It is also possible to have other materials blended in minor amounts with the polymers used to produce the fiber layer according to this invention like fluorocarbon chemicals to enhance chemical repellence which may be, for example, any of those taught in U.S. Pat. No. 5,178,931, fire retardants, ultraviolet radiation resistance or photostability improving chemicals, and pigments to give each layer the same or distinct colors. Fire retardants and pigments for spunbond and meltblown thermoplastic polymers are known in the art and are internal additives. A pigment, e.g. $TiO_2$, if used, is generally present in an amount less than 5 weight percentage of the layer while other materials may be present in a cumulative amount less than 25 weight percent.

Ultraviolet radiation resistance improving chemicals may be, for example, hindered amines and other commercially available compounds. Hindered amines are discussed in U.S. Pat. No. 5,200,443 to Hudson and examples of such amines are Hostavin TMN 20 from American Hoescht Corporation of Somerville, N.J. Chimassorb® 944 FL from the Ciba-Geigy Corporation of Hawthorne, N.Y. Cyasorb UV-3668 from American Cyanamid Company of Wayne, N.J. and Uvasil-299 from Enichem Americas, Inc. of New York.

Fabrics of this invention may also have topical treatments applied to them for more specialized functions. Such topical treatments and their methods of application are known in the art and include, for example, alcohol repellence treatments, anti-static treatments and the like, applied by spraying, dipping, etc. An example of such a topical treatment is the application of Zelec® antistat (available from E. I. duPont, Wilmington, Del.).

Sheath/core fibers have been successfully produced using this process with Shell's E5D47 polypropylene, a 38 melt flow rate polymer measured at 230° C. and 2060 grams, with about 2 weight percent of $TiO_2$, product code 41438, from Ampacet Corp., 660 White Plains Rd., Tarrytown, N.Y. 10591-5130. The polymer was liquefied by melting at a temperature of about 228° C. in a single extruder which pumped the polymer through a metering pump. The metering pump served to more precisely control flow and reduce fluctuations. It should be noted that a metering pump may not be necessary in other installations or may be replaced with other metering means known in the art. The polymer then entered a polymer pool from which it passed to a breaker plate, also called a distribution plate, which divided the polymer stream into two portions and directed the portions to each individual spinneret capillary. The two portions were subjected to the same process conditions while they were separated. The polymer portions were recombined at the spinneret and fiberized to produce fibers having an average diameter of about 20 microns at a rate of about 0.8 gram/hole/minute. The breaker plate was located adjacent to (directly above) the spinneret. The fibers were gathered on a foraminous mat to form about a 2 osy fabric.

Another, though more expensive, method to produce the single extruder multiportion fiber of this invention is to divide the polymer stream into portions after it exits the extruder, control the individual portions with individual metering pumps or other metering means, and direct the portions separately through a conventional conjugate fiber distribution plate until being recombined at an extrusion orifice or spinneret. Conventional conjugate fiber distribution plates accept two or more separate polymer streams and keep them separate until combining them at the spinneret. Such conventional conjugate fiber distribution plates do not divide the polymer stream.

Sheath/core fibers were also successfully produced using a biconstituent blend of about 2 weight percent nylon 6 from Nyltech and Shell's E5D47 polypropylene.

It has thus been shown that it is possible to produce fibers according to this process from a single extruder and the same polymer resulting in a single polymer-multiportion fiber. The process is simpler and less costly than traditional conjugate fiber systems since it uses only one extruder. Such fibers should have the improved distribution of crystallinity throughout the fiber found in traditional two-extruder conjugate fibers using the same polymer but at a lower capital and operating cost.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means plus function claims are intended to cover the structures described herein as performing the recited function and not only structural equivalents but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A process of producing a fiber comprising the steps of:

liquefying a polymer to form a polymer stream, dividing said polymer stream into at least two portions, recombining said polymer stream portions, and extruding said recombined polymer stream portions to form a single fiber, wherein said polymer stream portions have been substantially identically treated.

2. The process of claim 1 further comprising the step of cutting said fiber to form a staple fiber.

3. The process of claim 2 further comprising the step of collecting a plurality of said fibers on a surface to form a staple fiber web.

4. The process of claim 2 wherein said polymer is a polyester.

5. The process of claim 1 further comprising the step of collecting a plurality of said fibers on a surface to form a nonwoven fiber web.

6. The process of claim 5 further comprising the step of bonding said web by a method selected from the group consisting of needlepunching, stitchbonding, adhesive bonding, ultrasonic bonding and thermal bonding.

7. The process of claim 1 further comprising the step of collecting a plurality of said fibers and weaving said fibers to form a woven fabric.

8. The process of claim 1 further comprising the step of collecting a plurality of said fibers and knitting said fibers to form a knitted fabric.

9. The process of claim 1 wherein said polymer is selected from the group consisting of polyamides, polyurethanes, polyvinylchlorides, polytetrafluoroethylene, polystyrene, polyethylene terephathalate, polycarbonates, 4-methyl-1-pentene, rayon, acetates, polyesters, polyolefins, copolyether esters, polyamide polyether block copolymers, block copolymers having the general formula A—B—A', block copolymers having the general formula A—B, A—B—A—B tetrablock copolymers, and polymers having polydispersity numbers below 4.

10. The process of claim 9 wherein said polymer is polyolefin and said polyolefin is an ethylene polymer.

11. The process of claim 9 wherein said polymer is polyolefin and said polyolefin is a propylene polymer.

12. The process of claim 9 wherein said polymer is selected from the group consisting of urethane polymers.

13. The process of claim 9 wherein said polymer further comprises a compatible tackifying resin.

14. The process of claim 9 wherein said polymer further comprises additives selected from the group consisting of chemical repellence additives, fire retardants, photostability additives and pigments.

15. The process of claim 1 wherein said single fiber is in a configuration selected from the group consisting of sheath/core, islands-in-the-sea and side by side.

16. The process of claim 1 wherein said single fiber is a microfiber having a diameter of between about 0.5 microns and about 50 microns.

17. The process of claim 1 wherein said single fiber is a microfiber having a diameter of between about 10 microns and about 25 microns.

18. The process of claim 1 wherein said single fiber has a denier between about 100 and 200.

19. A process of producing a fiber comprising the steps, in this order, of:

liquefying a polymer to form a polymer stream, pumping said polymer stream, dividing said polymer stream into at least two stream portions, recombining said polymer stream portions, extruding said polymer stream portions through a spinneret, and forming a single multi-portion microfiber, wherein said polymer stream portions have been substantially identically treated.

20. The process of claim 19 further comprising the steps of collecting a plurality of said fibers on a surface and thermally bonding said fibers to form a nonwoven fiber web, wherein said polymer is a propylene polymer.

21. The process of claim 19 wherein said dividing step occurs in a distribution plate adjacent said spinneret.

* * * * *